United States Patent [19]

de Nora et al.

[11] 4,146,438

[45] Mar. 27, 1979

[54] SINTERED ELECTRODES WITH ELECTROCATALYTIC COATING

[75] Inventors: Vittorio de Nora, Nassau, The Bahamas; Placido M. Spaziante; Antonio Nidola, both of Milan, Italy

[73] Assignee: Diamond Shamrock Technologies S.A., Geneva, Switzerland

[21] Appl. No.: 774,101

[22] Filed: Mar. 7, 1977

Related U.S. Application Data

[63] Continuation-in-part of Ser. No. 672,279, Mar. 31, 1976, abandoned, Ser. No. 673,460, Apr. 5, 1976, abandoned, Ser. No. 681,279, Apr. 28, 1976, abandoned, and Ser. No. 686,943, May 17, 1976, abandoned.

[51] Int. Cl.[2] ..... C25B 11/08; C25C 5/04

[52] U.S. Cl. ..... 204/1.5; 204/67; 204/98; 204/100; 204/106; 204/129; 204/242; 204/243 R; 204/290 F

[58] Field of Search ..... 204/1.5, 67, 98, 100, 204/106, 129, 242, 243, 290 F

[56] References Cited

U.S. PATENT DOCUMENTS

| | | | |
|---|---|---|---|
| 3,632,498 | 1/1972 | Boer | 204/290 F |
| 3,804,740 | 4/1974 | Welch | 204/291 X |
| 3,810,770 | 5/1974 | Bianchi et al. | 204/290 F |
| 3,846,273 | 11/1974 | Bianchi et al. | 204/290 F |
| 3,926,751 | 12/1975 | de Nora et al. | 204/290 F |
| 3,930,967 | 1/1976 | Alder | 204/67 |
| 4,039,401 | 8/1977 | Yamada et al. | 204/290 F |

*Primary Examiner*—Leland A. Sebastian
*Attorney, Agent, or Firm*—Hammond & Littell

[57] ABSTRACT

Sintered electrodes for electrolytic processes comprising a self-sustaining body or matrix of sintered powders of an oxycompound of at least one metal selected from the group consisting of titanium, tantalum, zirconium, vanadium, niobium, hafnium, aluminum, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series and at least one electroconductive agent, the said electrodes being provided over at least a portion of their surface with at least one electrocatalyst for electrolysis reaction and bipolar electrodes, electrolytic cells containing said electrodes and electrolytic processes using the said electrodes as anodes and/or electrodes. Oxycompounds include oxides, multiple oxides, mixed oxides, oxyhalides and oxycarbides and mixtures thereof.

27 Claims, No Drawings

SINTERED ELECTRODES WITH ELECTROCATALYTIC COATING

PRIOR APPLICATION

This application is a continuation-in-part of our copending, commonly assigned application Ser. No. 672,279 filed Mar. 31, 1976 now abandoned, Ser. No. 673,460 filed Apr. 5, 1976 now abandoned, Ser. No. 681,279 filed Apr. 28, 1976, now abandoned, and Ser. No. 686,943 filed May 17, 1976, now abandoned.

STATE OF THE ART

Dimensionally stable electrodes for anodic and cathodic reactions in electrolysis cells have recently become of general use in the electrochemical industry replacing the consumable electrodes of carbon, graphite and lead alloys. They are particularly useful in flowing mercury cathode cells and in diaphragm cells for the production of chlorine and caustic, in metal electrowinning cells wherein pure metal is recovered from aqueous chloride or sulfate solution as well as for the cathodic protection of ships' hulls and other metal structures.

Dimensionally stable electrodes generally comprise a valve metal base such as Ti, Ta, Zr, Hf, Nb and W, which under anodic polarization develop a corrosion-resistant but non-electrically conductive oxide layer or "barrier layer", coated over at least a portion of their outer surface with an electrically conductive and electrocatalytic layer of platinum group metal oxides or platinum group metals (see U.S. Pat. Nos. 3,711,385, 3,632,498 and 3,846,273. Electroconductive and electrocatalytic coatings made of or containing platinum group metals or platinum group metal oxides are, however, expensive and are eventually subjected to consumption or deactivation in certain electrolytic processes and, therefore, reactivation or recoating is necessary to reactivate exhausted electrodes.

Furthermore, electrodes of this type are not operable in a number of electrolytic processes. For example, in molten salt electrolytes, the valve metal support is rapidly dissolved, since the thin protective oxide layer is either not formed at all or is rapidly destroyed by the molten electrolyte with the consequent dissolution of the valve metal base and loss of the catalytic noble metal coating. Moreover, in several aqueous electrolytes, such as fluoride solutions or in sea-water, the breakdown voltage of the protective oxide layer on the exposed valve metal base is too low and the valve metal base is often corroded under anodic polarization.

Recently, other types of electrodes have been suggested to replace the rapidly consumed carbon anodes and carbon cathodes used up to now in severely corrosive applications such as the electrolysis of molten metal salts, typically for the electrolysis of molten fluoride baths such as those used to produce aluminum from molten cryolite. In this particular electrolytic process which is of great economic importance, carbon anodes are consumed at a rate of approximately 450 to 500 kg of carbon per ton of aluminum produced and expensive constant adjustment apparatus is needed to maintain a small and uniform gap between the corroding anode surfaces and the liquid aluminum cathode. It is estimated that over 6 million tons of carbon anodes are consumed in one year by aluminum producers. The carbon anodes are burned away according to the reaction:

$$Al_2O_3 + 3/2\ C \rightarrow 2Al + 3/2\ CO_2$$

but the actual consumption rate is much higher due to fragilization and breaking away of carbon particles and to intermittent sparking which takes place across anodic gas films which often form over areas of the anode surface since carbon is poorly wetted by the molten salts electrolytes, or to short circuiting caused by "bridges" of conductive particles coming from the corroding carbon anodes and from dispersed particles of the depositing metal.

British Pat. No. 1,295,117 discloses anodes for molten cryolite baths consisting of a sintered ceramic oxide material consisting substantially of $SnO_2$ with minor amounts of other metal oxides, namely, oxides of Fe, Sb, Cr, Nb, Zn, W, Zr, Ta in concentration of up to 20%. While electrically conducting sintered $SnO_2$ with minor additions of other metal oxides, such as oxides of Sb, Bi, Cu, U, Zn, Ta, As, etc., has been used for a long time as a durable electrode material in alternating current glass smelting furnaces (see U.S. Pat. Nos. 2,490,825, 2,490,826, 3,287,284 and 3,502,597), it shows considerable wear and corrosion when used as an anode material in the electrolysis of molten salts. We have found wear rates of up to 0.5 grams per hour per $cm^2$ from samples of the compositions described in the patents mentioned above when operated in fused cryolite electrolyte at 3000 $A/m^2$. The high wear rate of sintered $SnO_2$ electrodes is thought to be due to several factors: (a) chemical attack by the halogen, in fact $Sn^{IV}$ gives complexes of high coordination numbers with halogen ions; (b) reduction of $SnO_2$ by aluminum dispersed in the electrolyte; and (c) mechanical erosion by anodic gas evolution and salt precipitation within the pores of the material. Japanese Patent application No. 112589 (Publication No. 62,114 of 1975) discloses electrodes having a conductive support of titanium, nickel or copper or an alloy thereof, carbon graphite or other conductive material coated with a layer consisting substantially of spinel and/or perovskite type metal oxides and alternatively electrodes obtained by sintering mixtures of said oxides. Spinel oxides and perovskite oxides belonging to a family of metal oxides which typically show good electronic conductivity and have been proposed previously as suitable electroconductive and electrocatalytic anodic coating materials for dimensionally stable valve metal anodes (see U.S. Pat. Nos. 3,711,382 and 3,711,297; Belgian Pat. No. 780,303).

Coatings of particulate spinels and/or perovskites have been found, however, to be mechanically weak as the bonding between the particulate ceramic coating and the metal or carbon substrate is inherently weak, because the crystal structure of the spinels and of the perovskites are not isomorphous with the oxides of the metal support and various binding agents such as oxides, carbides, nitrides and borides have been tried with little or no improvement. In molten salt electrolytes, the substrate material is rapidly attacked due to the inevitable pores through the spinel oxide coating and the coating is quickly spalled off the corroding substrate. Furthermore, spinels and perovskites are not chemically or electrochemically stable in molten halide salt electrolytes and show an appreciable wear rate due to halide ion attack and to the reducing action of dispersed metal.

In the electrolytic production of metals from molten halide salts, the mentioned anodes of the prior art have been found to have another disadvantage. The appreciable dissolution of the ceramic oxide material brings metal cations into the solution which deposit on the cathode together with the metal which is being produced and the impurity content in the recovered metal is so high that the metal can no longer be used for applications requiring electrolytic grade purity. In such cases, the economic advantages of the electrolytic process which are due, to a large extent, to the high purity attainable compared to the smelting processes are partially or entirely lost.

An electrode material to be used successfully in severely corrosive conditions such as in the electrolysis of molten halide salts and particularly of molten fluoride salts, should primarily be chemically and electrochemically stable at the operating conditions. It should also be catalytic with respect to the anodic evolution of oxygen and/or halides, so that the anode overpotential is lowest for high overall efficiency of the electrolysis process. The electrode should also have the thermal stability at operating temperatures of, i.e., about 200° to 1100° C., good electrical conductivity and be sufficiently resistant to accidental contact with the molten metal cathode. Excluding coated metal electrodes, since hardly any metal substrate could resist the extremely corrosive conditions found in molten fluoride salt electrolysis, we have systematically tested the performances of a very large number of sintered substantially ceramic electrodes of different compositions.

OBJECTS OF THE INVENTION

It is an object of the invention to provide novel sintered electrodes comprising an oxymetal matrix containing an electroconductive agent and provided over at least a part of its surface with an electrocatalyst.

It is another object of the invention to provide novel electrolytic cells wherein the anode is comprised of an oxymetal matrix containing an electroconductive agent and is provided over at least a portion of its surface with an electrocatalyst.

It is a further object of the invention to provide novel bipolar electrodes as well as novel electrolytic processes.

These and other objects and advantages of the invention will become obvious from the following detailed description.

THE INVENTION

The novel electrodes of the invention are comprised of a self-sustaining matrix of sintered powders of an oxycompound of at least one metal selected from the group consisting of titanium, tantalum, zirconium, vanadium, niobium, hafnium, aluminum, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, scandium and metals of the lanthanide and actinide series and at least one electroconductive agent, the said electrodes being provided over at least a portion of their surface with at least one electrocatalyst. Preferred metals of lanthanide and actinide series are lanthanum, terbium, erbium, thorium and ytterbium.

The "sintered" electrode is meant to describe a self-sustaining, essentially rigid body consisting principally of an oxymetal compound and at least one electroconductive agent produced by any of the known methods used in the ceramic industry such as by the application of temperature and pressure to a powdered mixture of the materials to shape the mixture to the desired size and shape, or by casting the material in molds, by extrusion, or by the use of bonding agents and so forth, and then sintering the shaped body at high temperature into a self-sustaining electrode. The oxyhalide compounds are preferably the oxychlorides or oxyfluorides.

The electrical conductivity of the sintered ceramic electrodes are improved by adding to the composition 0.1 to 20% by weight of at least one electroconductive agent selected from the group consisting of (A) doping oxides, typically of metals having a valence which is lower or higher than the valence of the metals of the oxides constituting the matrix, such as the alkaline earth metals Ca, Mg, Sr and Ba and metals such as Zn, Cd, $In_2$, $TL_2$, $As_2$, $Sb_2$, $Bi_2$ and Sn; (B) oxides showing electroconductivity due to intrinsic Redox system such as spinel oxides, perovskite oxides etc; (C) oxides showing electroconductivity due to metal to metal bonds such as $CrO_2$, $MnO_2$, TiO, $Ti_2O_3$ etc.; borides, silicides, carbides and sulfides of the valve metals such as Ti, Zr, Hf, V, Nb, Ta, Cr, Mo and W or the metals Y, Ti, Zr, Hf, V, Nb, Ta, Cr, Mo, W, Pd and Ag or alloys thereof or mixtures of (A) and/or (B) and/or (C).

The preferred electrocatalysts are selected from the group of metals consisting of ruthenium, rhodium, palladium, iridium, platinum, iron, cobalt, nickel, copper and silver and mixtures thereof and oxides of metals of the group consisting of manganese, iron, cobalt, nickel, ruthenium, rhodium, palladium, iridium, platinum, silver, arsenic, antimony, lead and bismuth and mixtures thereof.

By admixing with the powder of the matrix material, a minor amount, typically from 0.5 to about 30%, of powders of a suitable electrocatalytic material and by sintering the mixture into a self-sustaining body, it show, when used as an electrode, satisfactory electroconductive and electrocatalytic properties which retains its chemical stability even though the admixed catalyst would not be resistant per se to the conditions of the electrolysis.

The electrocatalyst may be a metal or an inorganic oxycompound. The preferred admixed catalyst powders are the powdered metals Ru, Rh, Pd, Ir, Pt, Fe, Co, Ni, Cu and Ag, especially the platinum group metals; powdered oxycompounds of Mn, Fe, Co, Ni, Ru, Rh, Pd, Ir, Pt, Ag, As, Sb and Bi and especially oxycompounds of the platinum group metals.

Specifically preferred are $\beta MnO_2$, $Co_3O_4$, $Rh_2O_3$, $IrO_2$, $RhO_2$, $Ag_2O$, $Ag_2O_2$, $Ag_2O_3$, $As_2O_3$, $Sb_2O_3$, $Bi_2O_3$, $CoMn_2O_4$, $NiMn_2O_4$, $CoRh_2O_4$ and $NiCo_2O_4$ and mixtures of said powdered metals and oxycompounds.

It has been found to be especially advantageous to add to the oxymetal compound a second material such as stannous oxide, zirconium oxide or the like and that also by adding a small amount of at least one metal belonging to the group comprising yttrium, chromium, molybdenum, zirconium, tnatalum, tungsten, cobalt, nickel, palladium and silver, both the mechanical properties and the electrical conductivity of the sintered electrodes are improved without appreciably decreasing their chemical and electrochemical corrosion resistance.

These additives are added in powder form and mixed with the powdered metal oxide in percentages which may range from 40 to 1% calculated in terms of weight of the metal content. Optionally, yet other organic and/or inorganic compounds may be added to the powder mixture to improve on the bonding of the particles during both the moulding and sintering processes.

The anodes have a high melting point well above the temperature of the molten salt electrolytes being used and they undergo no phase change under working conditions of the electrolysis. Moreover, the thermal elongation co-efficient is not far different from that of the halide salts used in the molten salt baths, which helps preserve the proper electrode spacing between the anode and the cathode and avoids expansions and contractions which might break the salt crust on the top of the molten salt electrolyte in the normal aluminum electrowinning process.

The conductivity of the sintered electrodes of the invention is comparable with that of graphite. The matrix has acceptable work-ability in the forming and sintering operation and in use forms a thin layer of oxyhalides on its surface under anodic conditions. The metal oxycompounds free formation energy is more negative than the oxide free formation energy of the corresponding halide-phase fused salt electrolyte, so that these sintered anodes have a high degree of chemically stability.

The sintered metal oxycompound electrodes of the invention may also be used as bipolar electrodes. According to this latter embodiment, the sintered electrodes may be conveniently produced in the form of a slab or plate whereby one of the two major surfaces of the electrode is provided with a layer containing the anodic electrocatalyst such as the oxides $CO_3O_4$, $Ni_3O_4$, $MnO_2$, $Rh_2O_3$, $IrO_2$, $RuO_2$, $Ag_2O$ etc. and the other major surface is provided with a layer containing suitable cathodic materials such as carbides, borides, nitrides, sulfides, carbonitrides etc. of metals, particularly of the valve metals and most preferably of yttrium, titanium and zirconium.

The self-sustaining sintered body consisting of a major portion of oxymetal compound may be prepared by grinding the materials together, or separately, preferably to a grain size between 50 and 500 microns, to provide a powder mixture which contains a range of grain sizes to obtain a better degree of compaction. According to one of the preferred methods, the mixture of powders is mixed with water or with an organic binding agent to obtain a plastic mass having suitable flowing properties for the particular forming process used. The material may be molded in known manner either by ramming or pressing the mixture in a mold or by slip-casting in a plaster of Paris mold or the material may be extruded through a die into various shapes.

The molded electrodes are then subjected to a drying process and heated at a temperature at which the desired bonding can take place, usually between 800 to 1800° C. for a period of between 1 to 30 hours, normally followed by slow cooling to room temperature. The heat treatment is preferably carried out in an inert atmosphere or one that is slightly reducing, for example in $H_2 + N_2$ (80%), when the powdered mixture is composed essentially of oxymetal compound with a minor portion of other metal oxides or metals.

When the powdered mixture contains also metallic powders, it is preferable to carry out the heat treatment in an oxidizing atmosphere, at least for a portion of the heat treatment cycle to promote the oxidation of metallic particles in the outside layers of the electrodes. The metallic particles remaining inside the body of the sintered material improve the electrical conductivity properties of the electrode.

The forming process may be followed by the sintering process at a high temperature as mentioned above or the forming process and the sintering process may be simultaneous, that is, pressure and temperature may be applied simultaneously to the powder mixture, for example by means of electrically-heated molds. Lead-in connectors may be fused into the ceramic electrodes during the molding and sintering process or attached to the electrodes after sintering or molding. Other methods of shaping, compressing and sintering the powder mixture may of course be used.

The electrocatalyst, usually applied to the electrode surface due to costs, should have a high stability, a low anodic overpotential for the wanted anodic reaction, and a high anodic overpotential for non-wanted reactions. In the case of chlorine evolution, oxides of cobalt, nickel, iridium, rhodium, ruthenium or mixed oxides thereof such as $RuO_2$-$TiO_2$ etc. can be used, and in the case of fluoride containing electrolytes wherein oxygen evolution is the wanted anodic reaction, oxides of silver and manganese are preferable. Other oxides for use as electrocatalysts may be oxides of platinum, palladium and lead.

Poisons for the suppression of unwanted anodic reactions may be used, such as, for example, to suppress oxygen evolution from chloride electrolytes. Poisons which present a high oxygen overpotential should be used and suitable materials are the oxides of arsenic, antimony and bismuth. These oxides which are used in small percentages may be applied together with the electrocatalyst oxides in percentage of 1 to 10% of the electrocatalyst calculated in terms of the respective metals weight.

The application of the electrocatalyst, and optionally of the poisoning agent may be effected by any of known coating methods. Preferably the electrocatalyst, and optionally the poisoning agent, are applied to the sintered electrodes as a solution of decomposible salts of the metals. The sintered body is impregnated with the solution containing the appropriate metal salts and dried. Hence the electrode is heated in air or in otherwise oxygen containing atmosphere to convert the salts into the wanted oxides.

Usually the porosity of the sintered body and the method used to impregnate the surface layers of the sintered body with the metal salts should provide for the pentration of the solution down to a depth of at least 1 to 5 millimeters, preferably 3 mm, inward from the surface of the electrode so that after the heat treatment the electrocatalysts are present in the pores of the sintered body down to a certain depth inward from the surface of the electrodes.

Alternatively, by appropriate powder mixing techniques, preformed electrocatalyst oxides and optionally preformed poisoning oxides, may be ground into powder form and added to the powder mixture during the moulding of the electrodes in such a way that the external layers of the moulded electrodes are enriched with powders of the electrocatalyst oxides, and optionally of the poisoning oxides, during the forming process whereby after sintering the surface of the electrodes is already provided with the electrocatalyst.

The sintered electrodes of the invention may be used as bipolar electrodes. According to this embodiment of the invention, electrodes may be provided over one surface with the anodic electrocatalyst, and optionally with the poisoning agent for the unwanted anodic reaction by one of the methods disclosed above while the other surface may be provided with a coating of suitable cathodic material. For example, the surface of the bipolar electrode which will function as a cathode during the process of electrolysis may be provided with a layer of metal carbides, borides, nitrides, sulfides and/or carbonitrides of yttrium, tantalum, titanium, zirconium, etc.

One preferred method to apply a layer is by plasma-jet technique whereby powders of the selected materials are sprayed and adhere to the surface of the sintered body with a flame under controlled atmosphere. Alternatively, the selected powdered material may be added during the forming process to the powder mixture and thence be sintered together whereby the cathodic surface of the bipolar electrode is provided with a layer of the selected cathodic material.

The electrodes may be used effectively for the electrolysis of many electrolytes. They are especially advantageous when used as anodes in electrolytic cells used for electrolyzing molten salt electrolytes such as molten cryolite baths, molten halides of aluminum, magnesium, sodium, potassium, calcium, lithium and other metals. Thus, aluminum halides may be electrolyzed according to the Hall process or processes disclosed in U.S. Pat. Nos. 3,464,900, 3,518,712 or 3,755,099 (the disclosure of which is incorporated herein by reference) using the electrodes herein described as anodes. The temperature of electrolysis is high enough to melt and maintain the salts of the metal to be recovered in a molten state and the metal is deposited in the molten state and usually collected as a molten cathode with molten metal being withdrawn from the molten cathode.

The electrodes may also be used effectively as anodes and/or cathodes in direct current electrolysis of other molten salt electrolytes typically containing halides, oxides, carbonates or hydrates for the production of aluminum, beryllium, calcium, cerium, lithium, sodium, magnesium, potassium, barium, strontium, cesium and other metals.

When the electrodes of the invention are used as bipolar electrodes for molten salt electrolysis, the composition of the cathode portion of the electrodes must be such that it will not be reduced by the cathodic reaction or attacked by the metal being deposited at the cathodes, particularly when the electrode composition is an oxycompound. For this reason, it is desirable to have the composition of the cathode side of the bipolar electrode inert to the cathodic reaction and the reducing action of the molten metal.

The electrodes may also be used as anodes and/or as cathodes in electrochemical processes such as: the electrolysis of aqueous chloride solutions for the production of chlorine, caustic, hydrogen, hypochlorite, chlorates and perchlorates; the electrowinning of metals from aqueous sulfate or chloride solutions for the production of copper, zinc, nickel, cobalt and other metals; the electrolysis of molten metal salt electrolytes typically containing halides, oxides, carbonates or hydrates for the production of aluminum, beryllium, calcium, lithium, sodium, magnesium, potassium, barium, strontium, cesium and other metals and the electrolysis of bromides, sulfides, sulfuric acid, hydrochloric acid and hydrofluoric acid. In general, the electrodes are useful for all electrolytic processes.

The novel electrolytic cell of the invention is comprised of at least one anode and at least one cathode and means for imposing a direct electric current between the anode and cathode, the improvement residing in the anode being comprised of a self-sustaining matrix of sintered powders of an oxycompound of at least one metal selected from the group consisting of titanium, tantalum, zirconium, vanadium, niobium, hafnium, aluminum, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series and at least one electroconductive agent, the said electrodes being provided over at least a portion of their surfaces with at least one electrocatalyst. The cell may also contain bipolar electrodes as described above.

The novel electrolysis method of the invention comprises electrolyzing an electrolyte between an anode and a cathode, the improvement residing in the anode being comprised of a self-sustaining matrix of sintered powders of an oxycompound of at least one metal selected from the group consisting of titanium, tantalum, zirconium, vanadium, niobium, hafnium, aluminum, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series and at least one electroconductive agent, the said electrodes being provided over at least a portion of their surface with at least one electrocatalyst.

In the following examples there are described several preferred embodiments to illustrate the invention. However, it should be understood that the invention is not intended to be limited to the specific embodiments. The percentages of the components of the electrodes are calculated in percent by weight and calculated as free metal based on the total metal content of the composition.

Among the preferred anodes are those wherein the major portion of the self-sustaining body is tin dioxide alone or with up to 20% by weight of cobalt oxide provided with a coating of cobalt oxide which give electrodes of improved mechanical properties and electrocatalytic properties for chlorine evolution. Other preferred additives are $Y_2O_3$, $TiO_2$ and $Ta_2O_5$.

The electrocatalyst coating may be protected against wear by the simultaneous or subsequent application of a protective agent such as a valve metal oxide like $TiO_2$ and $Ta_2O_5$ or $SiO_2$ mixed oxides such as $AgRe_2O_3$, $TiCo_2O_4$ and $Ag_xWO_3$.

EXAMPLE 1

Three sintered electrode samples, 80% $SnO_2$ + 20% cobalt (coupon A), 80% $SnO_2$ + 10% Co + 10% Mo (coupon B) and 100% $SnO_2$ (coupon C) were prepared and were then carefully washed with water and dried under vacuum. The resulting electrodes were then immersed under vacuum into the solution indicated in Table I and were then dried followed by heating at 370° C. for 20 minutes in a forced air circulation furnace. The samples were then brushed with the same solution and heated for 15 minutes at 350° C. in the same furnace and this procedure was repeated several times until the electrode had a weight gain of 5 g/m$^2$.

The electrode samples were then used as anodes in a test cell for the electrolysis of aluminum chloride at 750° C. and an anodic current density of 1000 A/m$^2$.

The cell voltage was 5 volts and the electrolyte was a 5-1-1 mixture by weight of aluminum chloride, sodium chloride and potassium chloride. The anodic potential was determined initially and after 500 hours of operation and the weight loss of the electrode was determined after 500 hours. For comparative purposes, a standard graphite electrode was also used under the same conditions and the results are reported in Table I.

TABLE I

| Coupon | Solution: Solvent | Solution: Salt | Anodic Potential V(RCGE)*: Initial | Anodic Potential V(RCGE)*: After 500 hrs. | Weight loss after 500 hrs g/m$^2$ |
|---|---|---|---|---|---|
| A | water and formamide | $CoCl_2$ | 0.45 | 0.47 | 0.8 |
| B | hydrochloric acid | $IrCl_3$ | 0.45 | 0.45 | 0.5 |
| C | hydrochloric acid | $IrCl_3$ | 0.5 | 0.6 | 0.2 |
| A | untreated | | 0.6 | 0.6 | 0.5 |
| B | untreated | | 0.55 | 0.55 | 0.5 |
| C | untreated | | 1.0 | 1.3 | Nil |

*RCGE: Reference chlorine graphite electrode.

The results of Table I show that the coated electrodes have an even lower overpotential for chlorine evolution without any substantial increase in weight loss. Sample C which had too high an overpotential without the post-treatment was not suited for the electrolysis reaction while the treated sample C is. The average faraday efficiency during the test was 96%. An ordinary graphite electrode used in the same way and compared to the reference graphite electrode showed a voltage of about 0.8 volts.

EXAMPLE 2

Samples of 90% by weight of tin dioxide and 10% by weight of cobalt were sintered and the electrodes were then provided with a coating of cobalt oxide as in Example 1 to obtain a layer of 10 g/m$^2$ of cobalt oxide. The electrodes were then used to electrolyze the electrolytes of Table II under the operating conditions recited therein. The anode potential after 300 hours of operation and the wear rate after 300 hours were determined and are reported in Table II.

TABLE II

| Electrolyte composition and weight ratio | Electrolyte Temp. ° C | Current Density A/m$^2$ | Average Faraday Efficiency | Anodic Potential after 300 hrs. V(RCGE) | Weight loss g/m$^2$ |
|---|---|---|---|---|---|
| $AlCl_3$+KCl (5:1) | 750 | 1000 | 92% | 0.5 | 0.5 |
| $CaCl_2$+KCl (5:1) | 450 | 1000 | 94% | 0.6 | 0.5 |
| $PbCl_2$+KCl (5:1) | 450 | 1000 | 90% | 0.6 | 0.5 |

Table II shows that the electrodes of the invention have a low wear rate and a low anode potential even after 300 hours of operation.

EXAMPLE 3

Disc-shaped electrodes with a diameter of 10 mm and a thickness of 5 mm were prepared from powders having a mesh number of 100 to 250. The powders were press-moulded at a pressure of 1000 Kg/cm$^2$ and were then sintered in an induction furnace under the conditions reported in Table III which also shows the compositions of the powders.

The sintering was conducted in a furnace through which the indicated gas was circulated or maintained at atmospheric pressure. Thus at least the external surfaces, and perhaps some of the external pores, were exposed to an oxidizing atmosphere at the temperature indicated and the exposed metal in the surfaces were oxidized to form the electrocatalyst.

TABLE III

| Sample No. | Components and Wt. Percentage | | Sinterization: Temp.° C. | Sinterization: Atmosphere | Time of Heating |
|---|---|---|---|---|---|
| 1 | $SnO_2$<br>Co | 80%<br>20% | 1250 | Forced air circulation | 2 hrs. |
| 2 | $SnO_2$<br>Co<br>Mo | 80%<br>10%<br>10% | 1500 | Forced air circulation | 2 hrs. |
| 3 | $SnO_2$<br>Mo<br>Ni | 80%<br>10%<br>10% | 1250 | Forced air circulation | 2 hrs. |
| 4 | $SnO_2$<br>$La_2O_3$<br>Co | 75%<br>10%<br>15% | 1500 | Ambient air | 2 hrs. |
| 5 | $SnO_2$<br>$Co_2NiO_4$<br>Co | 60%<br>30%<br>10% | 1500 | Ambient air | 2 hrs. |
| 6 | $SnO_2$<br>$SiO_3$<br>$La_2O_3$<br>$Co_2NiO_4$<br>Cu<br>Mo | 60%<br>10%<br>10%<br>10%<br>10% | 1000 | Ambient air | 2 hrs. |
| 7 | $SnO_2$<br>Co<br>Mo | 95%<br>2.5%<br>2.5% | 1500 | Forced air circulation | 2 hrs. |
| 8 | $SnO_2$ | 100% | 1500 | Air | 10 hrs. |

The electroconductivity of the Samples 1 to 7, measured at 500° C., was between 0.01 and 1.0$\Omega^{-1}$cm$^{-1}$ and the density of the sinterized electrodes varied between 5 and 8.5 g/m$^3$. The electrode samples were used as anodes in a test cell for the electrolysis of aluminum chloride at 750° C. and an anodic current density of 1000 A/m$^2$. The cell voltage was 5 volts and the electrolyte was a 5-1-1 mixture of aluminum chloride, sodium chloride and potassium chloride. The anodic potential was determined initially and after 500 hours of operation, and the weight loss of the electrode was determined after 500 hours. For comparative purposes, a reference graphite electrode was also used under the same conditions and the results are reported in Table IV.

TABLE IV

| Sample No. | V. Initial | Anodic Potential V.(RGE)*: After 500 Hrs. | Weight Loss After 500 Hrs. g/m$^2$ |
|---|---|---|---|
| 1 | 0.6 | 0.6 | 0.5 |
| 2 | 0.55 | 0.55 | 0.5 |
| 3 | 0.60 | 0.6 | 0.8 |
| 4 | 0.55 | 0.6 | 0.5 |
| 5 | 0.6 | 0.6 | Nil |
| 6 | 0.65 | 0.65 | 0.5 |
| 7 | 0.55 | 0.6 | Nil |
| 8 | 1.0 | 1.3 | Nil |
| Graphite | 0.85 | 0.85 | 105 |

*RGE: Reference graphite electrode

The results of Table IV show that electrodes 1 to 7, containing a major portion of an oxide and a minor portion of a metal, have a low over-potential for chlorine evolution and a very low wear rate. Electrode 8, which did not contain any additive electroconductive metal, had a substantially higher over-potential for chlorine evolution and the reference graphite electrode had an over-potential above the values for electrodes 1 to 7 and a high wear rate. The reference graphite anode needed substantial adjustments during the electrolysis and an early replacement. The average efficiency during the test was 97%. All of the samples 1 to 7, inclusive, were less brittle than Sample No. 8.

EXAMPLE 4

About 250 g of a mixture of the matrix material and additive materials indicated in Table I were ground in a mixer for 20 minutes and the powder mixtures were poured into cylindrical plastic molds and pre-compressed manually with a steel cylinder press. Each mold was placed in an isostatic pressure chamber and the pressure was raised to about 1500 Kg/cm$^2$ in 5 minutes and then reduced to zero in a few seconds. The samples were then taken out of the plastic molds and polished. The pressed samples were put into an electrically heated furnace and heated from room temperature to 1200° C. under a nitrogen atmosphere over a period of 24 hours, held at the maximum temperature for 2 to 5 hours and then cooled to 300° C. over the following 24 hours. The sintered samples were then taken out of the furnace and after cooling to room temperature, they were weighed and their apparent density and electrical conductivity at 25° C. and at 1000° C. were measured. The results are reported in Table V.

TABLE V

| Sample No. | Sample composition and percentage by weight | | Sintering time at max. temp. (hrs.) | Apparent density gr/cm$^3$ | Electrical conductivity at 1000° $\Omega^{-1}$ cm$^{-1}$ | Electrical conductivity at 25° C $\Omega^{-1}$ cm$^{-1}$ |
|---|---|---|---|---|---|---|
| | $ZrO_2$ | 60% | | | | |
| 1 | $Y_2O_3$ | 10% | 5 | 5.1 | 0.1 | — |
| | YOF | 10% | | | | |
| | $IrO_2$ | 20% | | | | |
| | $Ta_2O_5$ | 50% | | | | |
| | $La_2O_3$ | 5% | | | | |
| 2 | $SiO_2$ | 5% | 5 | 5.3 | 0.4 | — |
| | $VO_2$ | 20% | | | | |
| | $Co_3O_4$ | 20% | | | | |
| | $ZrO_2$ | 50% | | | | |
| 3 | $Ti_2O_3$ | 20% | 5 | 5.1 | 0.3 | — |
| | $ZrOCl_2$ | 20% | | | | |
| | $Rh_2O_3$ | 10% | | | | |
| | $Nb_2O_5$ | 30% | | | | |
| | $TiO_2$ | 20% | | | | |
| 4 | YOF | 20% | 5 | 5.6 | 0.5 | — |
| | $Ag_2O$ | 20% | | | | |
| | $Sb_2O_3$ | 10% | | | | |
| | $Y_2O_3$ | 20% | | | | |
| | $La_2O_3$ | 20% | | | | |
| 5 | $ThO_2$ | 20% | 5 | 5.8 | 0.7 | — |
| | $Ti_2O_3$ | 20% | | | | |
| | $Rh_2O_3$ | 20% | | | | |
| | $ZrO_2$ | 40% | | | | |
| | $Y_2O_3$ | 5% | | | | |
| | $SiO_2$ | 5% | | | | |
| 6 | $Zr_2OCl_2$ | 15% | 5 | 5.3 | 1.2 | — |
| | $Bi_2O_3$ | 10% | | | | |
| | $Ag_2O$ | 15% | | | | |
| | $RuO_2$ | 5% | | | | |
| | CuO | 5% | | | | |
| | $ZrO_2$ | 50% | | | | |
| | $Y_2O_3$ | 30% | | | | |
| 7 | $SnO_2$ | 10% | 5 | 5.9 | 1.0 | — |
| | $IrO_2$ | 8% | | | | |
| | CuO | 2% | | | | |
| | $ZrO_2$ | 30% | | | | |
| | $Yb_2O_3$ | 10% | | | | |
| 8 | $ThO_2$ | 10% | 5 | 5.8 | 0.8 | — |
| | $Ti_2O_3$ | 25% | | | | |
| | $SnO_2$ | 15% | | | | |
| | $Co_3O_4$ | 10% | | | | |
| | $TiO_2$ | 20% | | | | |
| | $Al_2O_3$ | 20% | | | | |
| 9 | $Ti_2O_3$ | 20% | 5 | 5.4 | 2.1 | — |
| | $SnO_2$ | 20% | | | | |
| | $\beta MnO_2$ | 20% | | | | |
| | $ZrO_2$ | 30% | | | | |
| | $Y_2O_3$ | 5% | | | | |
| 10 | YOF | 25% | 2 | 5.1 | 4 | 0.5 |
| | Y | 20% | | | | |
| | $RuO_2$ | 20% | | | | |
| | $TiO_2$ | 20% | | | | |
| | $Ta_2O_5$ | 30% | | | | |
| 11 | $VO_2$ | 10% | 2 | 5.7 | 5 | 0.9 |
| | $Fe_2O_3$ | 10% | | | | |
| | $Co_3O_4$ | 10% | | | | |
| | Co | 20% | | | | |
| | $TiO_2$ | 40% | | | | |
| | TiOC | 25% | | | | |
| 12 | $SnO_2$ | 15% | 5 | 6.3 | 12 | 1.6 |
| | $RuO_2$ | 5% | | | | |
| | Mo | 10% | | | | |
| | Ti | 5% | | | | |
| | $TiO_2$ | 40% | | | | |
| | $Ta_2O_5$ | 10% | | | | |
| 13 | $Ti_2O_3$ | 10% | 5 | 6.1 | 10 | 2.5 |
| | $Co_3O_4$ | 20% | | | | |
| | Mo | 10% | | | | |
| | $As_2O_3$ | 10% | | | | |
| | $ZrO_2$ | 40% | | | | |
| | $Y_2O_3$ | 5% | | | | |

TABLE V-continued

| Sample No. | Sample composition and percentage by weight | | Sintering time at max. temp. (hrs.) | Apparent density gr/cm$^3$ | Electrical conductivity at 1000° $\Omega^{-1}$ cm$^{-1}$ | Electrical conductivity at 25° C $\Omega^{-1}$ cm$^{-1}$ |
|---|---|---|---|---|---|---|
| 14 | $VO_2$ | 25% | 2 | 6.5 | 15 | 2.5 |
| | AgO | 20% | | | | |
| | Pd | 1% | | | | |
| | Mo | 9% | | | | |

The data in Table V shows that the electrical conductivity of the sintered ceramic electrodes at high temperatures of 1000° C. is 5 to 10 times higher than the electrical conductivity at 25° C. The addition of oxides having conductivity equivalent to metals to the substantially non-conductive ceramic oxides of the matrix increases the conductivity of the electrodes by a magnitude of $10^2$. The addition of a metal stable to molten salts such as yttrium or molybdenum, etc. to the ceramic electrodes of the invention increases the electrical conductivity of the electrodes by 2 to 5 times.

EXAMPLE 5

The conditions of operation of an electrolysis cell for the production of aluminum metal from a molten cryolite bath were simulated in a laboratory test cell. In a heated crucible of graphite, a layer of liquid aluminum was provided on the bottom and a melt consisting of cryolite (80 to 85%), alumina (5 to 10%) and $AlF_3$ (from 1 to 5%) was poured on top thereof. The sample electrodes with a working surface area of 3 cm$^2$ prepared according to the procedure described in Example 4 and to which a Pt wire was brazed to provide an easy means for electrical connection were dipped into the salt melt and held at a distance of about 1 cm from the liquid aluminum layer. The crucible was maintained at a temperature ranging from 950° to 1050° C. and the current density was 0.5 A/cm$^2$ and the cell was operated for 2000 hours. The experimental data obtained is shown in Table VI. The sample number indicates that the electrode tested corresponds to the sample described in Table V with the same number.

TABLE VI

| Sample No. | Aluminum produced (g/h) | Weight loss of anodes (g/cm$^2$) |
|---|---|---|
| 1 | 0.49 | 0.02 |
| 2 | 0.50 | 0.12 |
| 3 | 0.49 | 0.04 |
| 4 | 0.49 | 0.02 |
| 5 | 0.48 | 0.01 |
| 6 | 0.49 | 0.04 |
| 7 | 0.49 | 0.06 |
| 8 | 0.46 | 0.18 |
| 9 | 0.46 | 0.2 |

The test sample electrodes operated successfully as anodes in the cryolite melt and the observed wear rates appear to be quite acceptable for the electrolytic production of aluminum from molten cryolite. All the tested electrodes showed a low wear rate during 2000 hours of operation. In general, the wear rate of the electrodes containing thermal stabilizers such as oxycompounds of metals of Group III of the Periodic Table is about 10 times less than the electrodes without thermal stabilizers.

EXAMPLE 6

Electrodes Nos. 4 and 5 described in Table V were used as anodes for the electrolysis of a molten aluminum chloride electrolyte in the test cell described in Example 5. The electrolysis conditions were the following:

| | | | |
|---|---|---|---|
| | : | $AlCl_3$ | from 31 to 35% b.w.t. |
| | | NaCl | from 31 to 35% b.w.t. |
| | | $BaCO_3$ | from 31 to 35% b.w.t. |
| Temperature of Electrolyte | : | | from 690 to 720° C |
| Anodic current density | : | | 2000 Amp/m$^2$ |
| Cathode | : | Molten Aluminum | Aluminum |
| Interelectrodic gap | : | 1 cm. | |

The tested electrodes operated successfully and the weight losses after 2000 hours of operation were negligible.

EXAMPLE 7

Electrode samples Nos. 10 and 11 of Example 1 were used as anodes for the electrolysis of an aqueous bromide solution to produce bromine using a test diaphragm type cell with an asbestos diaphragm to separate the cathode compartment with a steel cathode from the anode compartment with the test electrode as the anode. The electrolysis was effected with an aqueous solution of 200–220 g/l of sodium bromide and the electrolyte temperature was 80° to 85° C. with a current density of 2000 A/m$^2$. The current efficiency was 95% and after 1000 hours of operation, the weight loss of the test electrode was negligible.

EXAMPLE 8

Electrode samples Nos. 10, 11 and 13 of Example 1 were used alternatively as anode and as cathode in the electrolysis of synthetic sea-water in a test cell in which the electrolyte was pumped through the electrodic gap of 3 mm at a speed of 3 cm/sec. The current density was maintained at 1500 A/m$^2$ and the spent electrolyte contained 0.8 to 2.4 of sodium hypochlorate with a faraday efficiency of more than 88%. The weight loss of the electrodes after 200 hours of operation was negligible.

EXAMPLE 9

Electrode samples Nos. 12 and 14 of Example 1 were used as anodes in the electrolysis of an aqueous acidic cupric sulfate solution in a cell with a titanium cathode blank. The electrolyte contained 150 to 200 gpl of sulfuric acid and 40 gpl of cupric sulfate as metallic copper and the anode current density was 300 A/cm$^2$. The electrolyte temperature was 60° to 80° C. and an average of 6 mm of copper were deposited on the flat cathode at a faraday efficiency ranging from 92 to 98%. The quality of the metal deposit was good and free of dendrites and the anode overvoltage was very low, ranging from 1.81 to 1.95 V(NHE).

Other electrocatalysts which may be used in the electrolysis of molten halide salts for halide ion discharge are $RuO_2$ and oxides such as $As_2O_3$, $Sn_2O_3$ and $Bi_2O_3$ may be added in percentages up to 10% by weight of free metal based upon the total metal content to rise the oxygen overpotential without affecting the halide ion discharge potential.

For anodes to be used in molten fluoride electrolytes where oxygen is evolved, the catalyst may be those listed in Example 5 or $Rh_2O_3$, $PbO_2$ and $IrO_2.TiO_2$.

The components of the anodes given in the Examples are calculated in percent by weight of free metal based upon the total metal content of the anode composition.

The electrolyte may contain other salts than those used in the Examples such as alkali metal chloride or fluoride as well as the salt of the metal undergoing electrolysis. The metal halides are effective to reduce the melting point of the salt undergoing electrolysis thus permitting use of lower temperatures while maintaining the salt bath in molten or melted state.

The above examples include fused or molten metal salt electrolysis, primarily the electrolysis of molten aluminum chloride or fluoride salts. In a similar manner, the molten chlorides of other metals such as alkali metal or alkaline earth metals may be electrolyzed using the designated anodes, according to otherwise standard practice. In addition, other molten salts, such as the molten nitrates, may be electrolyzed in the same way. A molten alumina-cryolite electrolyte or the like-alkali metal aluminum fluoride may be electrolyzed to produced molten aluminum.

These electrodes may be used in place of graphite anodes in standard aluminum electrowinning cells with either aluminum ore feed into a cryolite bath or with aluminum chloride feed into a predominately aluminum chloride bath.

The use of these sintered metal oxide anodes for the recovery of the desired metals from fused salts of the metals to be won results in reduced power consumption per unit weight of metal produced and in purer recovered metals. The electrodes are dimensionally stable in service and therefore do not require frequent interventions to restore the optimum distance from the cathode surface as is necessary with the consumable anodes of the prior art.

Various modifications of the electrodes and processes of the invention may be made without departing from the spirit or scope of our invention and it is to be understood that the invention is intended to be limited only as defined in the appended claims.

We claim:

1. An electrode comprising a self-sustaining matrix of sintered powders of an oxycompound of at least one metal selected from the group consisting of titanium, tantalum, zirconium, vanadium, niobium, hafnium, aluminum, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series and at least one electroconductive agent, the said electrodes being provided over at least a portion of their surface with at least one electrocatalyst.

2. The electrode of claim 1 wherein the electroconductive agent is a minor portion of the sintered electrode body and is an oxide of at least one metal selected from the group consisting of zirconium and tin.

3. The electrode of claim 1 wherein the electroconductive agent is a minor portion of the sintered electrode body and is at least one metal selected from the group consisting of yttrium, chromium, molybdenum, zirconium, tantalum, tungsten, cobalt, nickel, palladium and silver.

4. The electrode of claim 1 wherein the electrocatalyst is at least one member selected from the group consisting of oxides of cobalt, nickel, manganese, rhodium, iridium, ruthenium and silver.

5. The electrode of claim 1 wherein the electrocatalyst is formed in situ on said sintered electrode body from a solution of salts of said metals which are converted to oxides on said sintered electrode body.

6. The electrode of claim 4 in which the electrocatalyst is comprised of powdered oxides of said metals sintered into the outer layers of said electrode.

7. In an electrolytic cell for molten salt electrolysis comprising at least one anode and one cathode and means for imposing a direct current beteen the anode and cathode, the improvement wherein the anode is an electrode of claim 1.

8. The cell of claim 7 wherein the electroconductive agent is a minor portion of the sintered electrode body and is an oxide of at least one metal selected from the group consisting of zirconium and tin.

9. The cell of claim 7 wherein the electroconductive agent is a minor portion of the sintered electrode body and is at least one metal selected from the group consisting of yttrium, chromium, molybdenum, zirconium, tantalum, tungsten, cobalt, nickel, palladium and silver.

10. The cell of claim 7 wherein the electrocatalyst is at least one member selected from the group consisting of oxides of cobalt, nickel, manganese, rhodium, iridium, ruthenium and silver.

11. The cell of claim 10 wherein the electrocatalyst is formed in situ on said sintered electrode body from a solution of salts of said metals which are converted to oxides on said sintered electrode body.

12. The cell of claim 10 in which the electrocatalyst is comprised of powdered oxides of said metals sintered into the outer layers of said electrode.

13. A bipolar electrode comprising a self-sustaining matrix of sintered powders of an oxycompound of at least one metal selected from the group consisting of titanium, tantalum, zirconium, vanadium, niobium, hafnium, aluminum, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series and at least one electroconductive agent, the said electrodes being provided over at least a portion of their surface with at least one electrocatalyst on its anodic surface and over at least a portion of its cathodic surface with a layer of cathodic material selected from the group consisting of metal carbides, borides, nitrides, sulfides and carbonitrides and mixtures thereof.

14. The electrodes of claim 13 wherein the electroconductive agent is a minor portion of the sintered electrode body and is an oxide of at least one metal selected from the group consisting of zirconium and tin.

15. The electrode of claim 13 wherein the electroconductive agent is a minor portion of the sintered electrode body and is at least one metal selected from the group consisting of yttrium, chromium, molybdenum, zirconium tantalum, tungsten, cobalt, nickel, palladium and silver.

16. The electrode of claim 13 wherein the electrocatalyst is selected from the group consisting of oxides of cobalt, nickel, manganese, rhodium, iridium, ruthenium, silver and mixtures thereof.

17. The electrode of claim 13 wherein the electrocatalyst is formed in situ on said sintered electrode body from a solution of salts of said metals which are converted to oxides on said sintered electrode body.

18. The electrode of claim 13 in which the electrocatalyst is comprised of powdered oxides of said metals sintered into the outer layers of said electrode.

19. The electrode of claim 13 wherein the layer of the said cathodic material is applied by flame spraying.

20. The electrode of claim 13 wherein the layer of the said cathodic material comprises powders of said cathodic material sintered into the outer cathodic surfaces of said electrode.

21. The electrode of claim 13 wherein the cathodic material is selected from the group comprising carbides, borides, nitrides, sulfides and carbonitrides of at least one metal selected from the group consisting of yttrium, titanium, and zirconium.

22. The process for effecting an electrolysis reaction with an anode and cathode, the improvement comprising using as the anode an electrode of claim 1.

23. The process of claim 22 wherein the electroconductive agent is a minor portion of the sintered electrode body and is an oxide of at least one metal selected from the group consisting of zirconium and tin.

24. The process of claim 22 wherein the electroconductive agent is a minor portion of the sintered electrode body and is at least one metal selected from the group consisting of yttrium, chromium, molybdenum, zirconium, tantalum, tungsten, cobalt, nickel, palladium and silver.

25. The process of claim 22 wherein the electrocatalyst is at least one member selected from the group consisting of oxides of cobalt, nickel, manganese, rhodium, iridium, ruthenium and silver.

26. The process of claim 22 wherein the electrocatalyst is formed in situ on said sintered electrode body from a solution of salts of said metals which are converted to oxides on said sintered electrode body.

27. The process of claim 25 in which the electrocatalyst is comprised of powdered oxides of said metals sintered into the outer layers of said electrode.

* * * * *